United States Patent [19]

Beharry

[11] 4,272,447

[45] Jun. 9, 1981

[54] CRUDE EDIBLE OIL WAX REMOVAL PROCESS

[75] Inventor: Christopher R. Beharry, Cincinnati, Ohio

[73] Assignee: The Procter & Gamble Company, Cincinnati, Ohio

[21] Appl. No.: 106,959

[22] Filed: Dec. 26, 1979

[51] Int. Cl.[3] ..... C11B 3/06

[52] U.S. Cl. ..... 260/425

[58] Field of Search ..... 260/425

[56] References Cited

U.S. PATENT DOCUMENTS

| | | | |
|---|---|---|---|
| 2,412,251 | 12/1946 | Clayton | 260/425 |
| 2,564,407 | 8/1951 | Parkin | 260/425 |
| 3,943,155 | 3/1976 | Young | 260/425 |
| 4,035,402 | 7/1977 | Levine | 260/425 |

*Primary Examiner*—John F. Niebling

*Attorney, Agent, or Firm*—Leonard Williamson; Eric W. Guttag; Richard C. Witte

[57] ABSTRACT

This invention relates to an improved process for refining and dewaxing crude vegetable oils and, more particularly, to a process in which efficient separation of undesirable waxes (about 60% to 90%) can be consistently achieved in refining crude oils such as sunflower, safflower, and corn oil.

A process for bulk dewaxing and refining crude vegetable oil comprising the steps of: tempering said crude vegetable oil for wax nucleation at a temperature of from about 75° F. to about 120° F. for at least about 24 hours; then cooling and holding said tempered crude vegetable oil for wax agglomeration at a temperature of from about 40° F. to about 70° F. for at least 5 hours; refining said tempered and cooled oil at a temperature of about 80° F.–90° F., with an aqueous alkali solution to provide a mixture of a wax containing aqueous phase and a refined oil phase; heating said mixture to a maximum temperature of about 120° F.; and separating said oil phase from said aqueous phase.

16 Claims, No Drawings

CRUDE EDIBLE OIL WAX REMOVAL PROCESS

BACKGROUND OF THE INVENTION

This invention relates to an improved process for refining and dewaxing crude vegetable oils and, more particularly, to a dilute lye and soda ash process in which efficient separation of undesirable waxes (about 60% to 90%) can be consistently achieved in refining crude oils such as sunflower, safflower, and corn oil.

In order to build superior taste into edible oil products, certain processing steps must be undergone.

Refining removes the major impurities, such as excess fatty acids and gummy substances, from the oil by treating it with dilute lye and soda ash. Usually, however, further treatment is necessary before the oil is ready for use.

Unwanted color is removed from the oil by bleaching. The oil is mixed with a special kind of clay, called "fuller's earth." The clay absorbs the colored material from the oil. The mixture is then filtered, allowing the oil to run out clear.

Unpleasant odors are removed by blowing superheated steam through heated oil. Since the senses of taste and smell are closely linked, deodorization will also improve the flavor of the product.

The refined oil is further dewaxed to provide a refrigerator stable oil, i.e. one that does not cloud when chilled in a refrigerator.

U.S. Pat. Nos. 4,194,956 and 4,200,509 relate to the use of an electrofilter to dewax refined vegetable oils for refrigerator clarity. The refined oils are tempered first to nucleate, and then cooled to agglomerate the waxes before being electrofiltered.

Attempts have been made to refine and dewax crude vegetable oils using only one separation step. U.S. Pat. No. 3,943,155 to Young, Mar. 9, 1976, discloses a process for refining and dewaxing crude vegetable oils using only one separation step which removes both the hydrophilic and waxy components from the crude oil. An alkali and dewaxing treatment is employed to crude oil at a temperature of from about 15° F. to about 45° F.

U.S. Pat. No. 3,994,943, Gibble et al, Nov. 30, 1976, relates to dewaxing crude vegetable oils with a mixture of special surfactants. Crude oil tempering for wax nucleation and cooling for wax agglomeration is not taught in either the Young or Gibble et al patents.

Heretofore, efficient refining consistency in alkali wax removal from said crude edible oil has been erratic. Wax removal using an alkali process varied from almost 0% to about 90% removal using prior art techniques. It has now been discovered that the efficiency is dependent on crude oil temperatures and the time held at these temperatures before bringing the oils to a refining temperature for alkali treatment.

While the concept of combined refining and dewaxing as a single operation which would yield wax-free, refined sunflower seed oil is a desirable objective, as a practical matter there remains a need to refine oil using existing refining equipment and the alkali processes with only minimal modification.

It is, therefore, an object of the present invention to provide an improved process to dewax crude vegetable oils using the alkali process to reduce the wax load in a subsequent dewaxing operation.

It is also an object of this invention to provide a reliable refinery process which consistently removes about 60% to about 90% of the wax.

Other objects of this invention will become apparent in the light of the disclosure.

SUMMARY OF THE INVENTION

According to the present invention, up to about 90% of waxes in crude vegetable oils can be consistently removed when the crude oils are (1) tempered for at least 24 hours at a temperature of from about 75° F. to about 120° F. to nucleate wax crystals, (2) then they are cooled to about 40° F. to about 70° F. and held there for at least about 5 hours, (3) then the tempered and cooled oils are brought to a temperature of about 85° F.±10° F., preferably ±5° F., and refined with dilute alkali and soda ash, and (4) further dewaxed to provide a refrigerator-stable oil.

DETAILED DESCRIPTION OF THE INVENTION

This invention is, in some respects, a combined refining and dewaxing process but the process is primarily designed to reduce the wax load on a further dewaxing step in the production of refrigerator stable oils, particularly sunflower oil.

In the refining of crude oils, particularly in certain geographical areas, like Chicago where the summers are hot and the winters are cold, the varying weather conditions have affected the refining of crude oils which are stored in tanks in the fields. The varying temperature of the oil in the fields was surprisingly discovered as the cause of erratic fluctuations in crude oil wax level removal which varied from about zero to about 90% removal. The wax removal fluctuation caused by weather conditions had to be recognized before a solution could be found.

The improvement provided by the present invention is illustrated in the following examples.

EXAMPLES

An experiment performed using bench scale refining techniques demonstrates the advantage of this invention over the prior art practice:

A sample of crude oil was heated to 170° F. to eliminate the prior temperature history of the oil, then cooled to 85° F. and held there for 24 hours. At 85° F. the oil was divided into two parts. One part was held at 85° F., which is prior art refining practice. The other part was cooled to 40° F. and held for 5 hours and then heated back up to 85° F. Both oils were then refined and centrifuged in a manner to duplicate conditions seen in normal continuous refining. The results are shown in Table I.

METHOD FOR BENCH SCALE REFINING USED IN TEMPERED CRUDE OIL WORK.

The reactor vessel used was a large Sunbeam mixing bowl. Agitation was provided by the Sunbeam Mixmaster being run at 500 rpm.

Each sample of oil was put into the bowl at ~85° F. With the mixer running, the alkali reagents were slowly poured into the oil. The alkali reagents consisted of 3% by weight, total oil basis, 24°Bé soda ash, and 0.78% 24°Bé lye, mixed together in one beaker. °Bé=degrees Baumé, a unit of concentration based on the density of the solution. Temperature of the mixed reagents was ~80° F. Mixing continued for 15 minutes.

The oil mixture was heated to 120° F. and then poured into a 600 ml centrifuge bottle and centrifuged for 10 minutes at ~1500 rpm.

The oil was then poured off the top of the centrifuge bottle. This wet refined oil was then heated to 150° F. and filtered with ~1% filter earth to remove soap and water.

The resultant refined and filtered oil was then analyzed for wax esters. The results are shown in Table I.

TABLE I

| | ppm wax | % wax removal efficiency |
|---|---|---|
| Crude sun oil | 742 | — |
| Normal 85° refined | 595 | 20% |
| 40° chilled oil | 140 | 81% |

Thus, this example demonstrates a process for refining crude oil which removed over 80% of the waxes. According to the present invention, when crude oils are in the field they are (1) tempered at a temperature of from about 75° F. to about 120° F. to nucleate wax crystals, (2) then they are cooled to about 40° F. to about 70° F. and held there for at least about 5 hours, (3) then they are brought to a temperature of about 85° F. and refined with dilute alkali and soda ash and further processed as refined oils are in the prior art processes described above.

In an effort to keep the wax level in refined sunflower seed oil as low as possible while working within present refining practices, an experiment was performed using bench scale refining techniques.

These refining conditions and results agree with plant experiences in refining sunflower oil during winter months producing oil with low wax levels and refining oil in summer time producing oil with high wax levels which are more difficult to dewax.

Experience has shown that crude oil with a wax level of 742 ppm can have 595 ppm when refined using prior art practices. The crude oil was held at a temperature of 85° F. for 24 hours to simulate a typical field temperature and holding time. This same oil when processed according to the method of this invention can have much lower wax levels as shown in Table II.

TABLE II

| Crude Oil Treatment | Resultant Wax Level | % Removal Efficiency |
|---|---|---|
| Prior process, ambient oil temperature refined at 85° F., centrifuged at 120° F. | 595 ppm | 20 |
| Cooled to 70° for 5 hrs., refined at 85°, centrifuged at 120° F. | 244 ppm | 67 |
| Cooled to 70° for 24 hrs., refined at 85°, centrifuged at 120° F. | 189 ppm | 75 |
| Cooled to 60° F. for 5 hrs., refined at 85° F., centrifuged at 85° F. | 140 ppm | 81 |
| Cooled to 60° F. for 5 hrs., refined at 85° F., centrifuged at 120° F. | 236 ppm | 68 |
| Cooled to 60° F. for 24 hrs., refined at 85° F., centrifuged at 85° F. | 163 ppm | 78 |
| Cooled to 60° F. for 24 hrs., refined at 85° F., centrifuged at 120° F. | 156 ppm | 79 |
| Cooled to 40° F. for 5 hrs., refined at 85° F., centrifuged at 120° F. | 140 ppm | 81 |

More work was done to determine the effect of crude oil tempering conditions on the wax level in refined oil.

Wax levels have been reported on four of these. All were refined at 85° and centrifuged at 120° after refining. The results are shown in Table III.

TABLE III

| Temperature | Time | ppm Wax | % Removal Efficiency |
|---|---|---|---|
| 50° | 12 hrs. | 264 | 64 |
| 50° | 24 hrs. | 274 | 63 |
| 60° | 12 hrs. | 236 | 68 |
| 80° | 24 hrs. | 434 | 42 |

For purposes of this document the term "wax" also means "high melting material" and is used interchangeably and intended to be generic to the many substances which can cause clouding in crude oils at temperatures of less than about 60° F.

A problem which arises in the purification of vegetable oils is that the crude oils tend to have high contents of undesirable insoluble material. Natural vegetable seed oils are composed of mixtures of many naturally produced chemical compounds, including not only the oily constituents, but also usually small percentages of natural phosphatides, vegetable waxes, pigments, and many other compounds. The oily constituents, namely, the glyceride esters of the long chain fatty acid of the saturated and unsaturated types make up the largest fraction of vegetable oils. Such materials to a large extent determine the properties of the oil, but the remaining constituents also exert a marked and sometimes detrimental effect, depending upon the use to which the oil is put.

A large portion of the high melting material can be removed from oils by a process known as "winterizing" in which the oils are carefully cooled to low temperatures for extended periods of time to permit precipitation of solid material. Solid material can then be removed by pressing or other separation procedures. However, not all of the high melting solid material is removed from oils by winterizing, and the oil still tends to cloud when stored for extended periods of time at low temperature. Moreover, the usual winterizing treatment undesirably tends to remove by entrainment a substantial portion of the olein fraction of the oil.

Like winterization, a large portion of the high melting materials can be removed by refining in which the oils are brought in from the fields at field temperatures and are brought to a temperature of about 85° F. and (1) are refined with dilute alkali. The oil mixture is then heated to a temperature of about 120° F. and is centrifuged, is water-washed, is rebleached, and is then (2) dewaxed for refrigeration clarity. A problem which arises in this refining process for crude oil is efficiency in wax removal at stage (1). It can vary from zero to about 90% removal. It has been discovered that the efficiency is dependent on oil field temperature control and residence time.

The process of this invention presents a process for producing a refined oil which can consistently remove up to about 90% of its waxes in stage (1). This process is useful for refining crude oils which contain waxes such as sunflower, safflower, or corn oil.

What is claimed is:

1. In a process for refining and dewaxing crude vegetable oil wherein said crude oil is treated with an aqueous alkali solution to provide a wax containing aqueous phase and a refined oil phase, said oil phase then being separated from said aqueous phase, the improvement which comprises the steps of:

(a) tempering said crude oil for wax nucleation at a temperature of from about 75° F. to about 120° F. for at least about 24 hours; then (b) cooling said tempered oil for wax agglomeration to a temperature of from about 40° F. to about 70° F. for at least about 5 hours;

(c) refining said tempered and cooled oil with an aqueous alkali solution at a temperature of from about 75° F. to about 95° F. to provide a mixture of a wax containing aqueous phase and a refined oil phase;

(d) heating said mixture to a maximum temperature of about 120° F., and separating said oil phase from said aqueous phase.

2. The process of claim 1 wherein said crude oil is selected from the group consisting of sunflower, corn and safflower oils.

3. The process of claim 2 wherein said crude oil is sunflower oil.

4. The process of claim 1 wherein said crude oil is tempered at a temperature of from about 80° F. to about 90° F.

5. The process of claim 1 wherein said tempered crude oil is cooled to a temperature from about 40° F. to 60° F.

6. The process of claim 1 wherein said tempered and cooled oil is held for at least 12 hours.

7. The process of claim 1 wherein said tempered and cooled oil is refined at a temperature of from about 80° F. to about 90° F.

8. The process of claim 1 wherein said refined oil is heated to a temperature of about 80° F. to 120° F. prior to separating said oil phase from said aqueous phase.

9. A process for refining and dewaxing crude vegetable oil which has been tempered for wax nucleation at a temperature of from about 75° F. to about 120° F. for at least about 24 hours and then cooled for wax agglomeration to a temperature of from about 40° F. to about 70° F. for at least about 5 hours, said method comprising the steps of:

(a) refining the tempered and cooled oil with an aqueous alkali solution at a temperature of from about 75° F. to about 95° F. to provide a mixture of a wax-containing aqueous phase and a refined oil phase;

(b) heating the mixture of aqueous phase and oil phase to a maximum temperature of about 120° F.; and (c) separating the oil phase from the aqueous phase after step (b).

10. A process according to claim 9 wherein the crude oil comprises sunflower oil.

11. A process according to claim 9 wherein the tempered and cooled oil is refined in step (a) at a temperature of from about 80° F. to about 90° F.

12. A process according to claim 11 wherein the refined oil of step (a) is heated to a temperature of from about 80° F. to 120° F. in step (b).

13. A process for refining and dewaxing crude vegetable oil which has been cooled for wax agglomeration to a temperature of from about 40° F. to about 70° F. for at least 5 hours, said method comprising the steps of:

(a) refining the cooled oil with an aqueous alkali solution at a temperature of from about 75° F. to about 95° F. to provide a mixture of a wax-containing aqueous phase and a refined oil phase;

(b) heating the mixture of aqueous phase and oil phase to a maximum temperature of about 120° F.; and (c) separating the oil phase from the aqueous phase after step (b).

14. A process according to claim 13 wherein the crude oil comprises sunflower oil.

15. A process according to claim 13 wherein the crude oil is refined in step (a) at a temperature of from about 80° F. to about 90° F.

16. A method according to claim 15 wherein the refined oil of step (a) is heated to a temperature of from about 80° F. to 120° F. in step (b).

* * * * *